US008061160B2

(12) United States Patent
Stinespring

(10) Patent No.: US 8,061,160 B2
(45) Date of Patent: Nov. 22, 2011

(54) ADJUSTABLE FASHION MECHANISM

(76) Inventor: Carissa Stinespring, Spring Grove, IL (US)

( * ) Notice: Subject to any disclaimer, the term of this patent is extended or adjusted under 35 U.S.C. 154(b) by 85 days.

(21) Appl. No.: 11/200,028

(22) Filed: Aug. 9, 2005

(65) Prior Publication Data

US 2006/0037359 A1 Feb. 23, 2006

Related U.S. Application Data

(60) Provisional application No. 60/602,212, filed on Aug. 17, 2004.

(51) Int. Cl.
*A44C 5/00* (2006.01)

(52) U.S. Cl. ..... 63/9; 59/80; 63/5.1

(58) Field of Classification Search ..... None
See application file for complete search history.

(56) References Cited

U.S. PATENT DOCUMENTS

| | | | | |
|---|---|---|---|---|
| 293,044 | A | | 2/1884 | Lewkowtiz |
| 294,277 | A | | 2/1884 | Schindler |
| 322,435 | A | | 7/1885 | Foster |
| 1,558,418 | A | | 10/1925 | Wendel |
| 2,146,272 | A | | 2/1939 | Skoog ..... 63/16 |
| 2,961,855 | A | | 11/1960 | Newman ..... 63/15.65 |
| 3,246,388 | A | | 4/1966 | Pasquale ..... 29/160.6 |
| 3,724,204 | A | * | 4/1973 | Frederick ..... 59/80 |
| 3,959,989 | A | | 6/1976 | Bhandia ..... 63/15.65 |
| 4,170,871 | A | * | 10/1979 | Vanover et al. ..... 59/82 |
| 4,261,185 | A | | 4/1981 | Martinez ..... 65/15.6 |
| 5,943,882 | A | | 8/1999 | Erb ..... 63/15.5 |
| 6,006,547 | A | * | 12/1999 | Bergagnini ..... 63/26 |
| 6,101,842 | A | * | 8/2000 | Delacretaz ..... 63/4 |
| 6,202,443 | B1 | | 3/2001 | Grosser-Samuels ..... 63/3 |
| 6,484,535 | B2 | | 11/2002 | Grosser-Samuels ..... 63/3 |
| 6,711,915 | B2 | | 3/2004 | Quach ..... 63/31 |
| D527,166 | S | * | 8/2006 | Hoeksema ..... D2/627 |

* cited by examiner

*Primary Examiner* — Jack W. Lavinder
(74) *Attorney, Agent, or Firm* — Husch Blackwell LLP

(57) ABSTRACT

An adjustable fashion mechanism having various combinations of extension and adjuster pieces that can be formed to create a bracelet which allows for size variations to fit any size wrist, arm or ankle. The same or similar configuration may be sized and styled differently for use as a necklace to be worn around a person's neck or as a ring for a person's finger. In yet other uses, the same or similar configuration may be sized and styled for use as an armband to be worn around a person's upper or lower arm. Other applications of the adjustable fashion mechanism may be used for clothing, different types of jewelry and accessories.

11 Claims, 5 Drawing Sheets

ADJUSTABLE FASHION MECHANISM

This application claims the benefit of U.S. Provisional Application No. 60/602,212, filed Aug. 17, 2004.

FIELD OF THE INVENTION

The present invention relates to an adjustable fashion mechanism for jewelry, clothing and fashion accessories, and more particularly to an adjustable mechanism that provides for adjustment of the size of jewelry, clothing and accessories to fit a variety of different sized persons.

BACKGROUND OF THE INVENTION

Adjustable jewelry, clothing, accessories and mechanisms for the same of various types are known in the art. Such devices are typically used to adjust necklaces, rings, bracelets, armbands, dresses, belts, shoes and other forms of jewelry and clothing to adapt to a person's particular body size and body weight. With regards to adjustable bracelets, armbands and necklaces, various attempts have been made in the past to provide adjustable bracelets and necklaces for ankles, wrists and/or necks for varying body types and body weights. Similar adjustable mechanisms and designs have been used for articles of clothing to modify the fit for a particular person's body.

Commonly, resizing a bracelet or necklace larger or smaller is a difficult task for a jeweler because during the resizing process a considerable amount of work is involved by the crafts-person. Also, manipulating the metal in a bracelet or necklace may weaken the metal or damage the metal thereby affecting the quality and aesthetics of the jewelry. Even if jewelry is sized to initially fit a particular person's ankle, arm, wrist, finger or neck, due to changes that occur such as the wearer's weight and changes in the weather, the jewelry still may not fit the person's ankle, arm, wrist, finger or neck properly all the time.

The present invention overcomes these and other problems inherent in existing adjustable fashion mechanisms for jewelry, clothing and accessories that use these mechanisms. In one embodiment, the present invention provides an adjustable fashion mechanism having various combinations of extension and adjuster pieces that can be formed to create a bracelet which allows for size variations to fit any size wrist, arm or ankle. The same or similar configuration may be sized and styled differently for use as a necklace to be worn around a person's neck or as a ring for a person's finger. In yet other uses, the same or similar configuration may be sized and styled for use as an armband to be worn around a person's upper or lower arm. Other applications of the adjustable fashion mechanism may be used for clothing, different types of jewelry and accessories.

BRIEF SUMMARY OF THE INVENTION

In one embodiment, the present invention provides an adjustable fashion mechanism having various combinations of extension and adjuster pieces that can be formed to create a bracelet which allows for size variations to fit any size wrist, arm or ankle. The same or similar configuration may be sized and styled differently for use as a necklace to be worn around a person's neck or as a ring for a person's finger. In yet other uses, the same or similar configuration may be sized and styled for use as an armband to be worn around a person's upper or lower arm. Other applications of the adjustable fashion mechanism may be used for clothing, different types of jewelry and accessories.

DETAILED DESCRIPTION OF THE INVENTION

Figure 1:
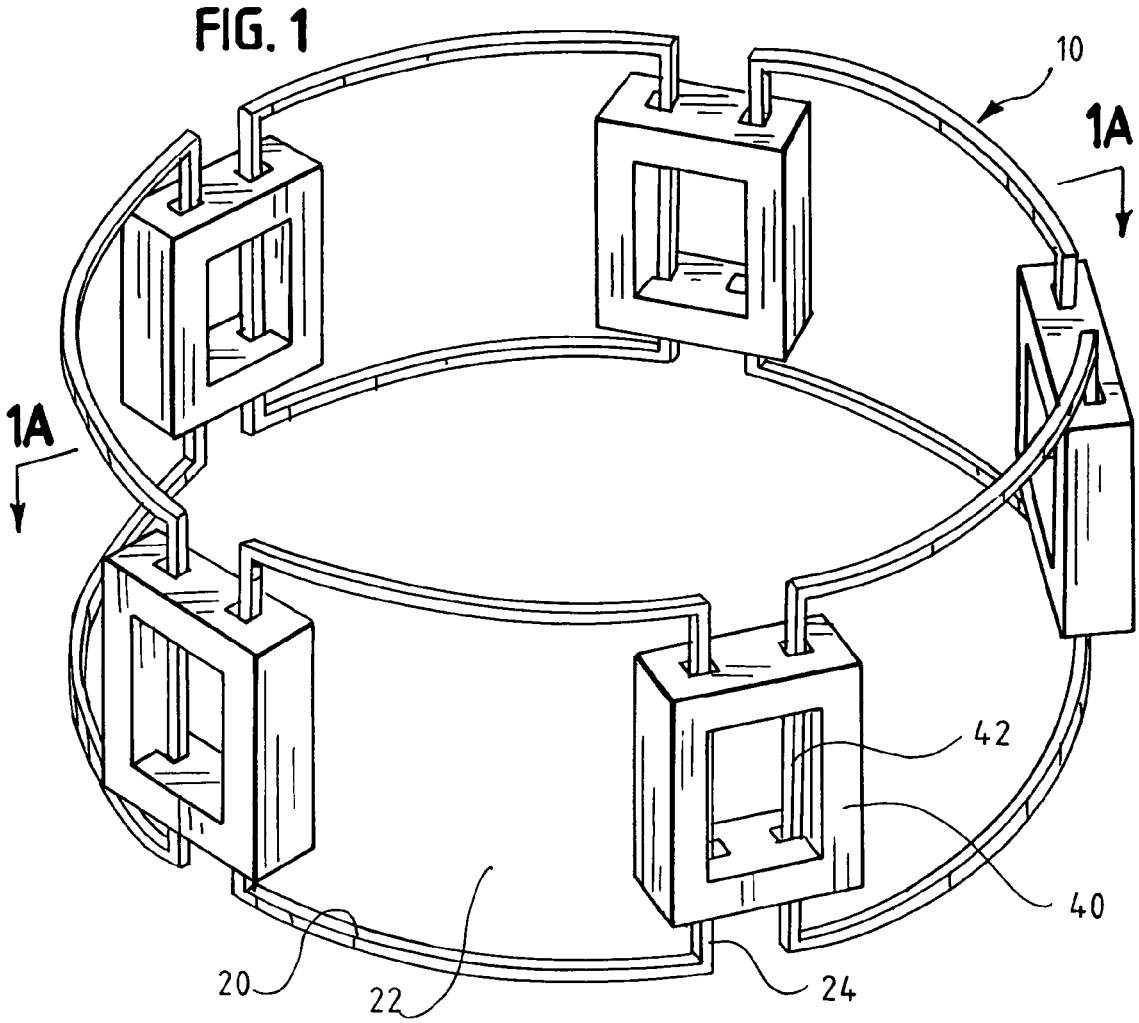
FIG. 1 is a perspective view of one embodiment of a bracelet shown constructed with the adjustable fashion mechanism of the present invention.

While the present invention is susceptible of embodiments in various forms, there is shown in the drawings and will hereinafter be described some exemplary and non-limiting embodiments, with the understanding that the present disclosure is to be considered an exemplification for the invention and is not intended to limit the invention to the specific embodiments illustrated. In this disclosure, the use of the disjunctive is intended to include the conjunctive. The use of the definite article or indefinite article is not intended to indicate cardinality. In particular a reference to "the" object or "a" object is intended to note also one of a possible plurality of such objects.

Figure 2:
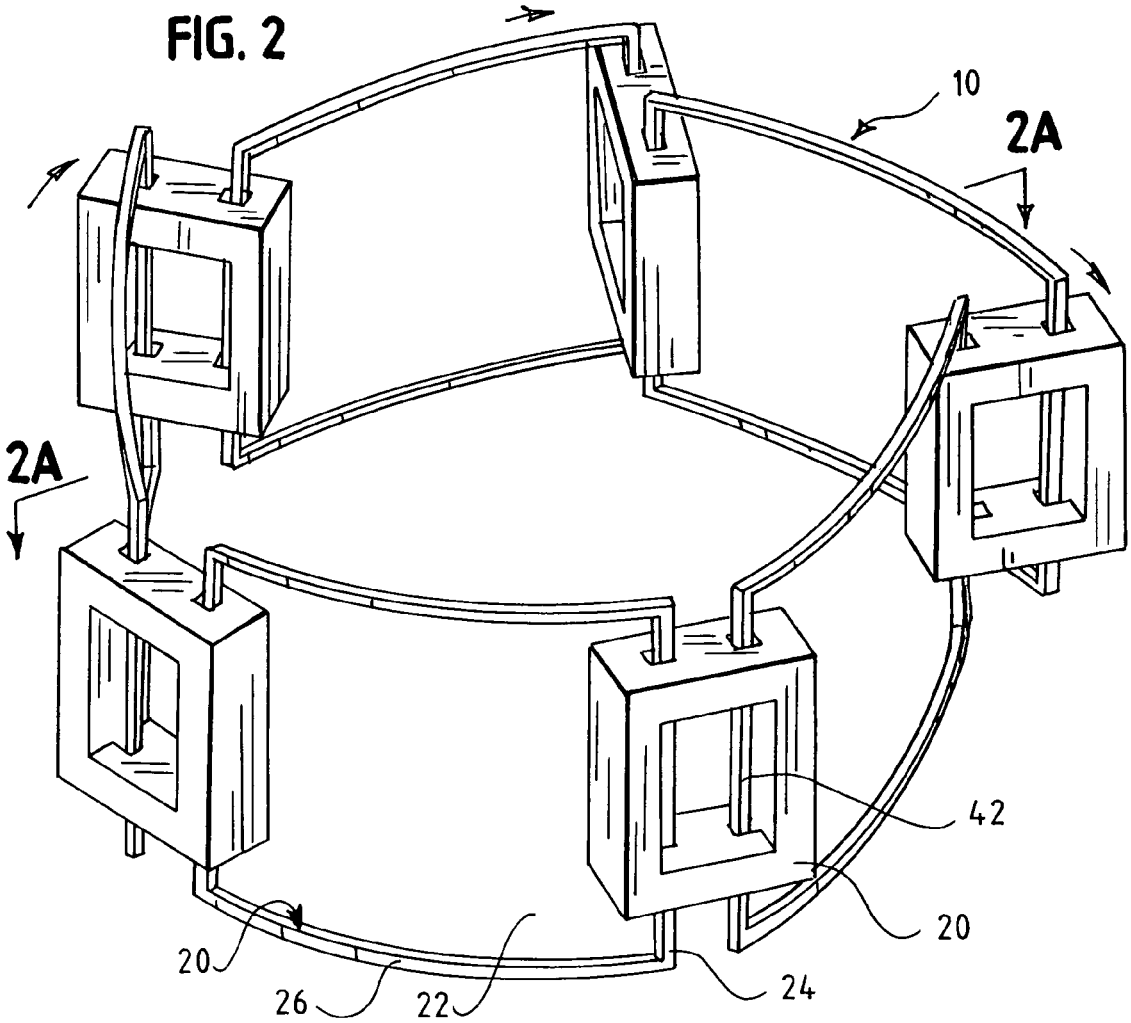
FIG. 2 is a perspective view of the bracelet of FIG. 1 shown whereby the inner diameter of the bracelet is reduced in size.

As shown in FIGS. 1-2, in one embodiment, the present invention provides an adjustable mechanism that can be formed to create a bracelet which allows for size variations to fit any size wrist, arm or ankle. The same or similar configuration may be sized and styled differently for use as a necklace to be worn around a person's neck or as a ring for a person's finger. In yet other embodiments, the same or similar configuration may be sized and styled for use as an armband to be worn around a person's upper or lower arm. Hereinafter it is understood that when referring to "bracelet" that the words "necklace" or "ring" or "armband" may be understood to be substituted.

Figure 5A:
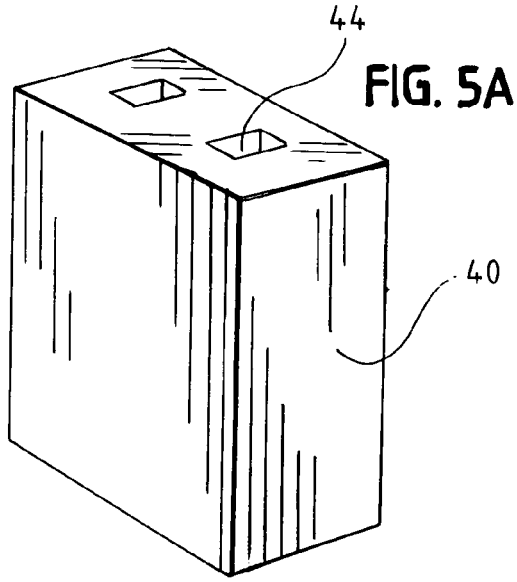
FIG. 5A is a perspective view of an alternate embodiment of an adjustable piece of the adjustable fashion mechanism.
Figure 5B:
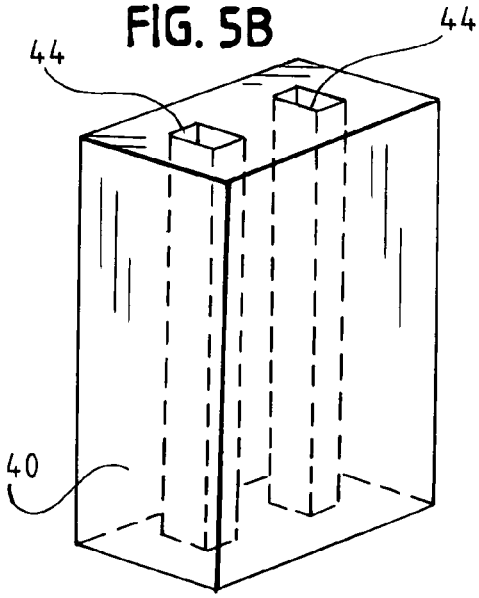
FIG. 5B is a perspective view of an alternate embodiment of an adjustable piece of the adjustable fashion mechanism.

In one embodiment, the bracelet 10 comprises elongated extension pieces 20 joined and held together by adjuster pieces 40 comprised of, in one embodiment, rubber flexible pieces having hollowed-out square or rectangular shaped holes 42 (or side holes) extending through the center of the pieces 40 or through only a portion of the pieces 40. The holes 42 in adjuster pieces 40 may also be other shapes than square or rectangular. In yet other embodiments, the pieces 40 may be constructed of other flexible materials such as a variety or combination of different rubber, plastic, natural or synthetic materials. In one embodiment, hole 42 may be positioned so that its center-line is positioned along the center-line of adjuster piece 40. In yet other embodiments, the center-line of hole 42 may not be along the same center-line of adjuster piece 40 and thereby hole 42 may be located in a variety of different positions within adjuster piece 40 depending upon a particular application. In still further embodiments, hole 42 may be rectangular or square-shaped substantially as shown in FIG. 1 or hole 42 may be a variety of different shapes such as circular, oval, triangular, octagonal and any other shape that will provide for the proper operation of adjustable piece 40. As shown in FIGS. 5A and 5B, for certain applications, adjuster piece 40 may not contain a hole 42. In yet other embodiments, adjuster piece 40 may contain multiple holes 42 positioned on either side of piece 40.

Figure 4:
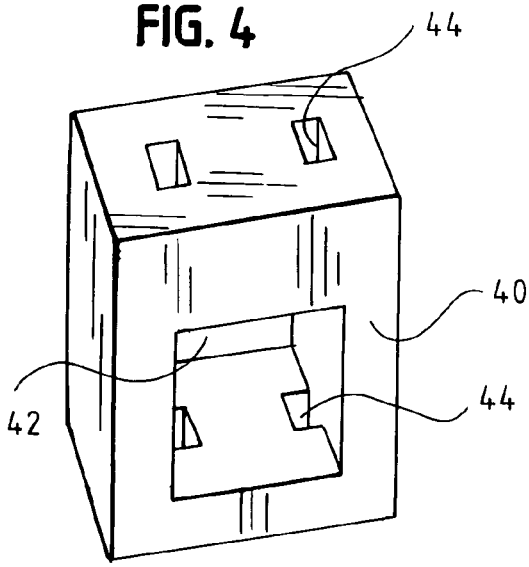
FIG. 4 is a perspective view of one embodiment of an adjustable piece of the adjustable fashion mechanism.

As shown in FIGS. 1, 2 and 4, adjuster piece 40 also contains, in one embodiment, four square-shaped holes 44 (or end holes) that provide for extension pieces 20 to pass through adjuster pieces 40. In one form, adjuster piece 40 contains four holes 44. In other embodiments, adjuster piece 40 may contain more than or less than four holes 44. For example, in one embodiment as shown in FIGS. 5A and 5B where adjuster piece 40 does not contain a hole 42, adjuster piece 40 may contain only two holes 44 that through adjuster piece 40 and provide for acceptance of extension pieces 20. In yet another embodiment, adjuster piece 40 may contain a hole 42 and whereby holes 44 pass through the solid portion of adjuster piece 40 and extension pieces 20 do not communicate with or pass through hole 42. In this example, adjuster piece 40 would contain two holes 44 that do not communicate with hole 42.

As shown in FIG. 1, adjuster pieces 40 are substantially rectangular shaped, in yet other applications or embodiments adjuster pieces 40 may be a variety of different shapes such as a cube, cylinder, cone, prism, sphere, pyramid and a variety of other 3-dimensional geometric shapes.

In one embodiment, extension pieces 20 may be constructed of metal wire having a square cross-sectional shape and are inserted into the holes 44 in adjuster pieces 40 allowing adjuster pieces 40 to flip or turn with respect to the extension pieces 20. Extension pieces 20 may have end portions 24, side portions 26 and open portions 22.

In one embodiment, a portion of end 24 passes through and is positioned inside of adjuster piece holes 44 whereby a substantially snug fit between the adjuster piece 40 and end portion 24 is realized. When adjuster piece 40 is rotated about end portion 24, adjuster piece 40 along the length of holes 44 experiences a flexing or movement to provide for end portion 24 to rotate within holes 44 with respect to adjuster piece 40. This flexing or movement creates an increased force on end portion 24 whereby a tighter fit between end portion 24 and adjuster piece 40 is realized. In yet other embodiments, adjuster piece 40 may be configured or comprised of materials having characteristics whereby the rotation of end portion 24 with respect to adjuster piece 40 experiences more or less resistance depending upon a variety of different factors. For example, holes 44 may be varied in size, material used to make adjuster piece 40 may be varied thereby experiencing different material properties, the inner walls of holes 44 may contain ridges, other indentations or surface modifications which provide greater or less resistance to the turning motion experienced between end portion 24 and adjuster piece 40.

During use, a user may increase or decrease the size or length of the adjustable fashion mechanism by rotating one or more of the adjuster pieces 40. For example, when the adjuster pieces 40 flip or turn with respect to the extension piece 20, the result is that the bracelet overall inner diameter becomes smaller allowing for a tighter fit as shown in FIG. 2. As shown in FIG. 1, if reversed by flipping adjuster pieces 40 in the opposite direction and moving pieces 20 further apart, the result is a looser fit because of the larger realized inner bracelet diameter.

Figure 3A:
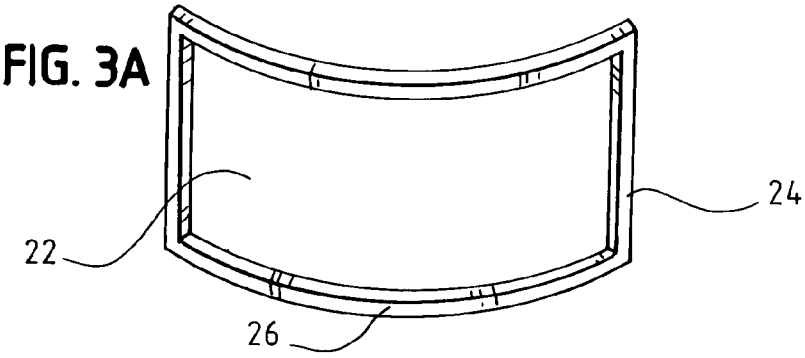
FIG. 3A is a perspective view of one embodiment of an extension piece of the adjustable fashion mechanism.
Figure 3B:
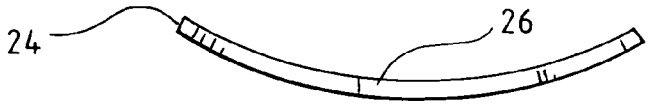
FIG. 3B is a side view of one embodiment of an extension piece of the adjustable fashion mechanism.
Figure 6:
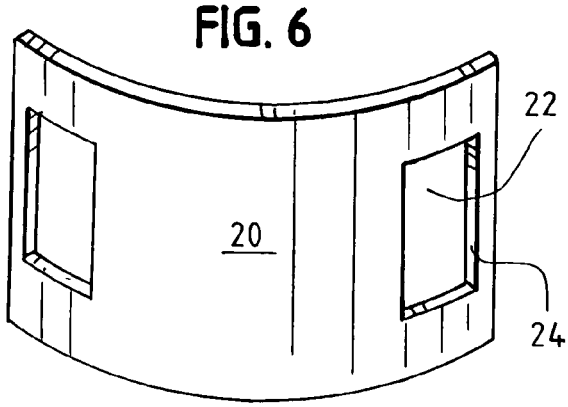
FIG. 6 is a perspective view of an alternate embodiment of an extension piece of the adjustable fashion mechanism.

In yet other embodiments, the cross-sectional shape of the material used to construct the extension pieces 20 may be other than square, for example, shapes such as triangle, octagonal, circular or still other shapes may be used. As shown in FIGS. 1, 2 and 3A, extension pieces 20 may contain an open area 22 substantially as shown. Open area 22 may be one continuous opening as shown in FIG. 1 or, as shown in FIG. 6, may be separated into multiple openings whereby separators 30 are formed that connect opposite ends of extension piece 20. In one form, separations 30 may have a variety of different aesthetic design features such as variations in color, texture, drawings, etc. Further, open area 22 may take up a considerably small percentage of overall area of extension piece 20 than shown in FIG. 1 whereby additional material is formed and attached to extension piece 20 to provide for aesthetic, ornamental or functional characteristics for extension piece 20. In one embodiment, as shown in FIGS. 1, 2, 3A and 3B extension piece 20 may be arched at a variety of different degrees or may be flat and not contain an arch.

In yet still other embodiments, holes 44 may be shaped other than square. For example, holes 44 may be shaped triangular, octagonal, circular, or still other shapes may be used. In one embodiment, holes 44 may be shaped octagonal and extension end 24 may be shaped octagonal whereby when end piece 24 is positioned within holes 44, extension piece 20 may rotate through up to eight distinct different positions as opposed to up to four distinct positions when square holes 44 and square extension end pieces 24 are used.

Figure 7:
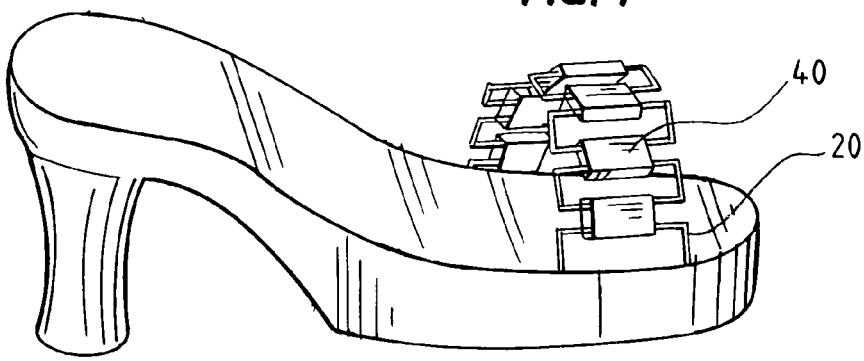
FIG. 7 is a perspective view of one embodiment of the adjustable fashion mechanism used on a shoe.

The adjustable fashion mechanism of the present invention may also be used for a variety of other applications whereby the mechanism may be used to adjust the fit of a particular type of clothing or fashion accessory. Shown in FIG. 7 is one embodiment of how the adjustable fashion mechanism may be used as a design element for a woman's shoe. In this embodiment, the adjustable fashion mechanism operates as described herein and is adjustably fastened to a shoe substantially as shown in FIG. 7. During use, a user may adjust the mechanism to fit her foot whereby a comfortable and secure fit is realized.

Figure 8:
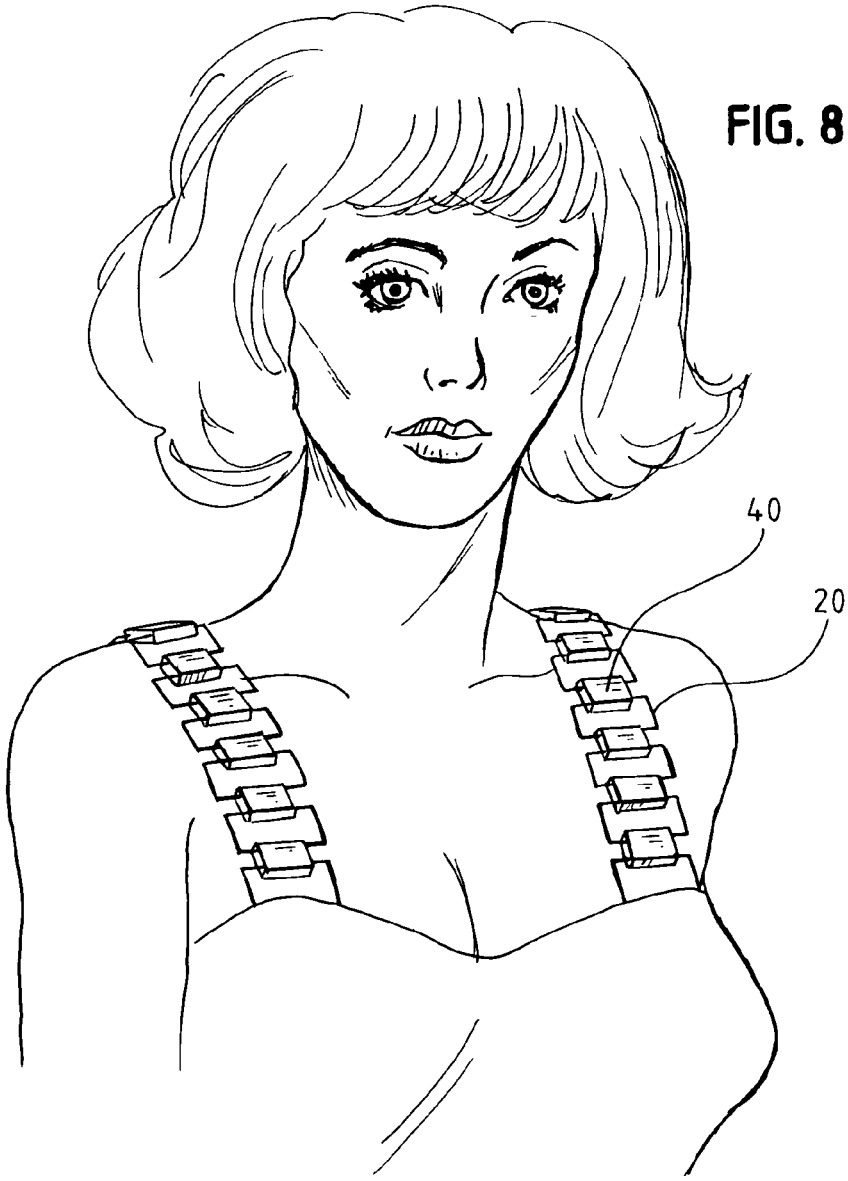
FIG. 8 is a perspective view of one embodiment of the adjustable fashion mechanism used on a dress.
Figure 9:
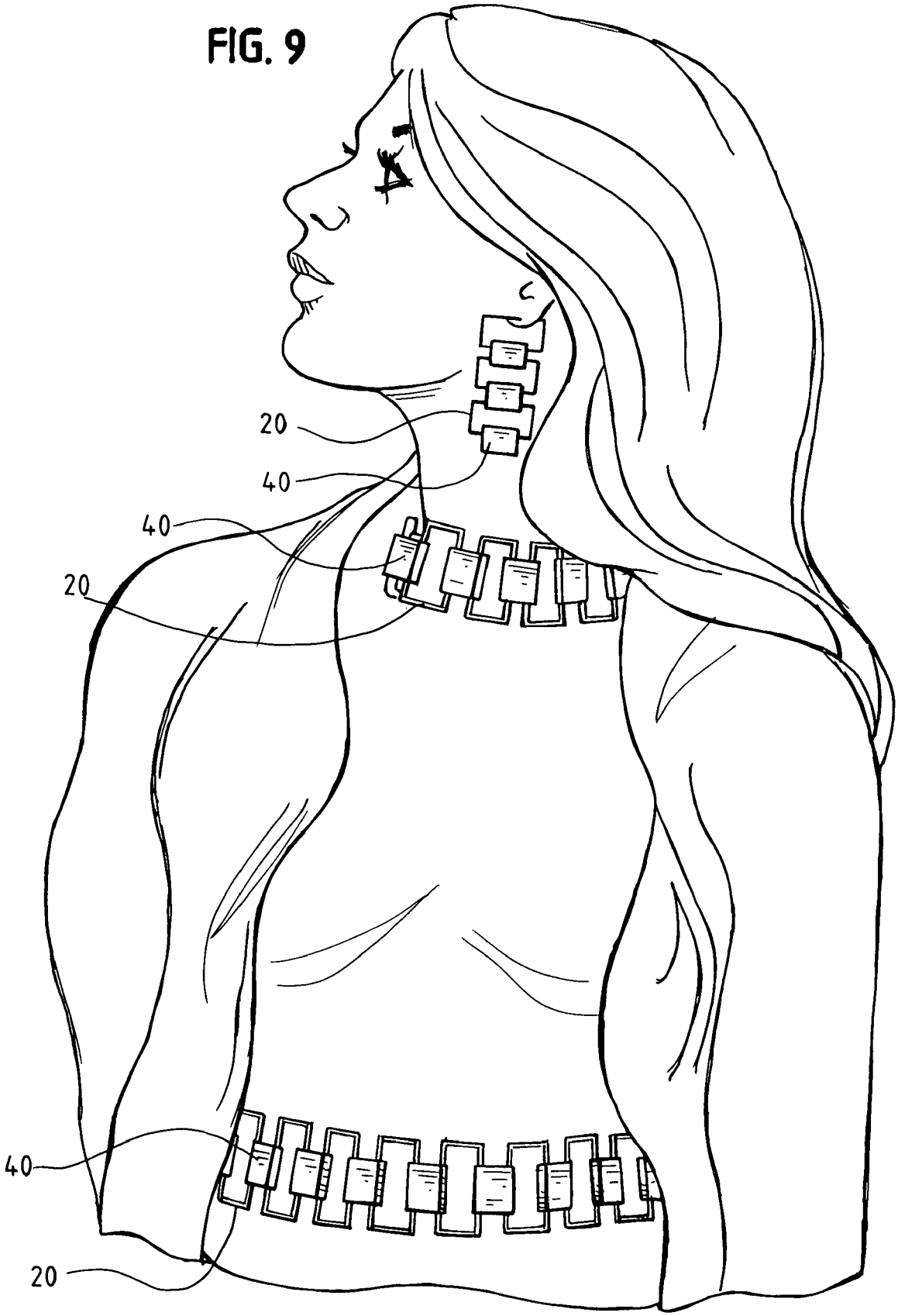
FIG. 9 is a perspective view of one embodiment of the adjustable fashion mechanism used as a belt, as an earring, and as a necklace.

In yet other applications, as shown in FIG. 8, the adjustable fashion mechanism may be used as a design element for a woman's dress whereby the mechanism is not only aesthetic but enables the user to adjust the fit of the dress. The mechanism operates substantially as described herein whereby the user can manipulate and adjust the size or length of the mechanism to provide for a comfortable fitting and securely fitting dress. Also, as shown in FIG. 9, the adjustable fashion mechanism may be used as an earring, worn as a necklace and worn as a belt. Multiple items comprised of various lengths of the adjustable fashion mechanism may be worn simultaneously to provide for an overall stylish, consistent fashion look. It also enables the user to easily adjust the various items to fit his or her body type. The adjustable fashion mechanism and the herein disclosed embodiments are for use by men or women.

Specific embodiments of novel methods and apparatus for construction of an adjustable fashion mechanism for jewelry, clothing and accessories according to the present invention have been described for the purpose of illustrating the matter in which the invention is made and used. It should be understood that the implementation of other variations and modifications of the invention and its various aspects will be apparent to one skilled in the art, and that the invention is not limited by the specific embodiments described. Therefore, it is contemplated to cover the present invention any and all modifications, or equivalents that follows in the true spirit and scope of the basic underlying principles disclosed and claimed herein.

The invention claimed is:

1. An adjustable fashion mechanism that can be worn by a person comprising:

a plurality of adjuster pieces comprised of a flexible rubber based material and each having a first end and a second end, a first side and a second side, two holes positioned at the first end and extending through each adjuster piece to the second end;

a plurality of extension pieces having a first end and a second end, and wherein the first end passes through a first adjuster piece hole and the extension piece second end passes through a second adjuster piece hole; the first end and second end are rotatably connected to at least one adjuster piece whereby each adjuster piece can rotate about an extension piece while the adjuster piece snuggly surrounds the extension piece portion within the hole whereby when the adjuster piece is rotated about the extension piece, the adjuster piece flexes to allow the extension piece to turn;

each adjuster piece defines a side hole that is positioned at the first side and extends through the adjuster piece to the second side whereby the adjuster piece holes communicate with the side hole and provide for visibility of a portion of extension piece end that passes through the side hole;

the adjuster pieces and extension pieces form a continuous loop whereby an extension piece is connected to a first and second end of each adjuster piece and an adjuster piece is connected to a first and second end of each extension piece; and each adjuster piece is rotatably connected to two extension pieces whereby when the adjuster piece is rotated, the inner circumference of the continuous loop is reduced in length or increased in length in proportion to the amount and direction of rotation of the adjuster piece and the increased or decreased size of the continuous loop is maintained in place during use of the fashion mechanism until a person wearing the fashion mechanism manually rotates at least one adjuster piece to a different position.

2. The adjustable fashion mechanism of claim 1 wherein the plurality of extension pieces comprises an open area positioned between the extension piece first end and the extension piece second end.

3. The adjustable fashion mechanism of claim 1 wherein the at least one extension piece comprises a first open area adjacent the extension piece first end and a second open area adjacent the extension piece second end and a separator portion defined between the two open areas.

4. The adjustable fashion mechanism of claim 1 wherein the cross-sectional area of adjuster piece end holes is square shaped.

5. The adjustable fashion mechanism of claim 4 wherein the cross-sectional area of the at least one extension piece is square shaped.

6. The adjustable fashion mechanism of claim 4 wherein the cross-sectional area of the at least one extension piece is octangonal shaped.

7. The adjustable fashion mechanism of claim 4 wherein the cross-sectional area of the at least one extension piece is triangular shaped.

8. The adjustable fashion mechanism of claim 4 wherein the cross-sectional area of the at least one extension piece is circular shaped.

9. The adjustable fashion mechanism of claim 1 wherein the cross-sectional area of adjuster piece end holes is octagonal shaped.

10. The adjustable fashion mechanism of claim 1 wherein the cross-sectional area of adjuster piece end holes is triangular shaped.

11. The adjustable fashion mechanism of claim 1 wherein the cross-sectional area of adjuster piece end holes is circular shaped.

* * * * *